US005578559A

United States Patent [19]

Dolan et al.

[11] Patent Number: 5,578,559

[45] Date of Patent: Nov. 26, 1996

[54] LAVATORY CLEANING BLOCK

[75] Inventors: Richard Dolan, Jersey City; Paul Riccobono, Bedminster, both of N.J.

[73] Assignee: Block Drug Company, Inc., Jersey City, N.J.

[21] Appl. No.: 62,118

[22] Filed: May 14, 1993

[51] Int. Cl.[6] ..... C11D 17/04; C11D 3/28

[52] U.S. Cl. ..... 510/192; 510/381; 510/447; 510/499; 510/500; 510/508; 4/227.1; 239/34

[58] Field of Search ..... 252/106, 91, 541, 252/544, 89.1, 102, 174

[56] References Cited

U.S. PATENT DOCUMENTS

| | | | |
|---|---|---|---|
| 2,863,800 | 12/1958 | Gottfried | 167/33 |
| 3,412,021 | 11/1968 | Paterson et al. | 252/106 |
| 4,200,606 | 4/1980 | Kitko | 422/37 |
| 4,242,216 | 12/1980 | Daugherty | 252/103 |
| 4,248,827 | 2/1981 | Kitko | 422/37 |
| 4,249,274 | 2/1981 | Kitko | 4/277 |
| 4,308,625 | 1/1982 | Kitko | 4/228 |
| 4,353,866 | 10/1982 | Wong | 422/37 |
| 4,420,412 | 12/1983 | Wong | 252/186.38 |
| 4,460,490 | 7/1984 | Barford et al. | 252/94 |
| 4,536,367 | 8/1985 | Hung | 422/37 |
| 4,536,368 | 8/1985 | Hung | 422/37 |
| 4,560,766 | 12/1985 | Girard et al. | 548/311 |
| 4,597,941 | 7/1986 | Bottom | 422/37 |
| 5,178,787 | 1/1993 | Hung et al. | 252/90 |

*Primary Examiner*—Joseph Conrad

*Attorney, Agent, or Firm*—Ostrolenk, Faber, Gerb & Soffen, LLP

[57] ABSTRACT

A toilet cleaning block that releases a halogen containing sanitizing agent in a controlled, substantially constant rate for about 2 to about 4 months of constant contact with water and is then completely dissolved in the water comprises an admixture of about 50% to about 80% by weight of a halogen containing sanitizing agent, about 20% to about 40% by weight of a bulking agent such as aluminum hydroxide and about 1 to about 20% by weight of a sacrificial dissolution rate regulating agent such as sodium chloride.

23 Claims, 2 Drawing Sheets

LAVATORY CLEANING BLOCK

BACKGROUND OF THE INVENTION

1. Field of the Invention

This invention relates to long-term, drop-in-tank lavatory sanitizing materials and to methods for making and using such materials.

2. Description of Related Art

One well-recognized source of germs in modern households is the toilet. Consumers spend considerable time and money in cleaning and sanitizing toilets. Not only is this difficult task unpleasant for many people, it also does not protect against proliferation of germs between cleanings.

One alternative to continual cleaning of the toilet is the use of in-tank articles that dispense a sanitizing agent into the toilet tank. These articles employ a chemical or combination of chemicals that release a halogen containing sanitizing agent when in contact with water. These articles have the advantage of providing continuous cleaning and sanitizing of the toilet, at least while the sanitizing agent remains in the tank.

If the release of the sanitizing agent is uncontrolled, the high equilibrium concentration of the halogen containing sanitizing agent may harm the tank itself and the equipment exposed to the halogen containing sanitizing agent in the tank. In order to control the halogen release rate, thereby controlling the harmful effects of uncontrolled release of the halogen into the tank, the halogen containing sanitizing agent is usually contained within some type of a dispensing system such as a container or a metering device.

One advantage of a container or metering device is that the useful life of any given unit of the halogen containing sanitizing agent is extended. Dispensing systems, however, are inconvenient, messy and must be removed from the tank and disposed of when the chemicals are exhausted. This disposal is unpleasant and can reduce the efficacy of germ killing by discouraging the consumer from replacing or replenishing exhausted supplies of the sanitizing agent.

Use of a product that can be simply dropped into the tank will eliminate the dispenser, but such a product reintroduces all of the problems that the dispenser was designed to circumvent. For instance, dispensers control the release rate of halogen containing sanitizing agent in three basic ways: they limit the quantity of water in contact with the agent; they limit the surface area of the material containing the agent exposed to the water; or they regulate the release rate of dissolved halogen containing sanitizing agent by controlling the release rate of the water containing the agent into the body of the tank. Without the container or dispenser, all of the water within the tank can come into contact with the entire exposed surface area of the chemicals.

Designing a drop-in product that releases the halogen containing sanitizing agent over a period of several hours is feasible. However, formulation difficulties increase rapidly as the active life of the product increases. In addition, the water in toilet systems does not flow continuously so maintaining rate of release within a constant range offers additional difficulties. The difficulty of obtaining a controlled, substantially constant rate of halogen containing sanitizing agent release, for example in the preferred range of the invention of about 0.5 to about 5 ppm, increases exponentially as the useful life increases beyond a time of about 1 week. Nevertheless, consumers do not wish to replenish a drop-in lavatory cleaning block constantly. Rather, consumers desire a product that only needs to be replaced after at least about 2 months, and preferably about every 3 to 4 months of use.

Consumers also have individual preferences for the duration of the toilet block. Some consumers prefer replacing the block every four months, for convenience, while others prefer changing the block about every two months so that it is easier to remember to replace the block. One simple way of regulating the duration of a block is by making the block bigger or smaller, so that the block will dissolve more or less quickly. Changing the size of a block, however, is not as simple as it seems. Changing the size of the block can change the release profile of the halogen containing sanitizing agent because of the change in block surface area.

Others have tried to regulate the release rate of a halogen containing sanitizing agent, with varying degrees of success. U.S. Pat. No. 2,863,800 to Gottfried, issued Dec. 9, 1958, for example, is directed to a composition for increasing the dissolution rate of 1,3-dichloro-5,5-dimethyl hydantoin (a halogen containing sanitizing agent) in water. The solution for obtaining maximum solubility "within a matter of seconds" offered in that patent is the addition of a comminuted wetting agent. One of the formulations discussed in that patent comprised 280parts by weight 1,3-dichloro-5,5-dimethyl hydantoin, 300 parts by weight NaCl, 360 parts by weight $Na_2SO_4$, 50 parts by weight $NaH_2PO_4$, and 10 parts by weight of a series of wetting agents. The patent also mentions that the tendency of the formulation to form "wet, gummy masses" is avoided by the addition of sodium or potassium chloride. Anhydrous sodium sulfate, although a useful material for retarding moistening of the composition during storage, cannot act as a substitute for sodium chloride in the composition.

Another patent, U.S. Pat. No. 5,178,787 to Hung et al., issued Jan. 12, 1993 is directed to a toilet cleaning block that releases a halogen containing sanitizing agent in a controlled, substantially constant rate for about 2to about 4months of constant contact with water. Although the results obtained by practice of this patent are excellent, the combination of about 4% to about 10% aluminum hydroxide and about 90% to about 96% halogen containing sanitizing agent is expensive.

Accordingly there is still a need in the art for a formulation that can deliver the performance obtainable from U.S. Pat. No. 5,178,787 to Hung et al, without the associated cost. The formulation should also be able to provide a reliable mechanism for tailoring useful life of the product to individual customer preferences without the need for reformulation.

SUMMARY OF THE INVENTION

The principal object of the invention is to provide a toilet cleaning block that releases a halogen containing sanitizing agent at a controlled, substantially constant rate for 2 to 4 months of constant contact with water. At the end of this time the block should be completely dissolved by the water.

An additional object of the invention is to provide a formulation that regulates the release of the halogen containing sanitizing agent with substantially the same release profile as the block of U.S. Pat. No. 5,178,787 to Hung et al. while being able to provide both a two month size and a four month size having congruent release profiles.

An advantage of the invention is that the invention uses a less expensive mixture of materials than the mixture found in the Hung et al. patent to achieve a very similar release profile.

Additional objects and advantages of the invention will be set forth in part in the description that follows, and in part will be obvious from this description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the invention provides a toilet cleaning block that releases a halogen containing sanitizing agent in a controlled, substantially constant rate for about 2 to 4 months of continuous contact with water and its use. More particularly, the block comprises an admixture of an agent that releases a halogen containing sanitizing agent when in contact with water, a given quantity of a bulking agent such as aluminum hydroxide, a sacrificial rate regulating agent, and, optionally, a mold release lubricant. The admixture is preferably in the form of a coherent solid resistant to internal water penetration. The solid preferably has a density from about 1.3 to about 1.8 g/cc, a ratio of effective surface area to weight from about 1:1.05 to about 1:1.25, and a crush fracturing strength from about 9 to about 109 kg.

To further achieve the foregoing objects and in accordance with the purpose of the invention, the invention further provides a method for making the toilet block by mixing the halogen containing sanitizing agent, the bulking agent, the sacrificial dissolution rate regulating agent, and the optional internal mold lubricant in the absence of added water to form an admixture. The admixture is then molded into a coherent solid that is resistant to internal water penetration.

BRIEF DESCRIPTION OF THE DRAWINGS

While this specification concludes with claims particularly pointing out and distinctly claiming that which is regarded as the invention, the objects and advantages of this invention may be more readily ascertained from the following description of a preferred embodiment when read in conjunction with the accompanying drawings.

DESCRIPTION OF THE PREFERRED EMBODIMENTS

Figure 1:
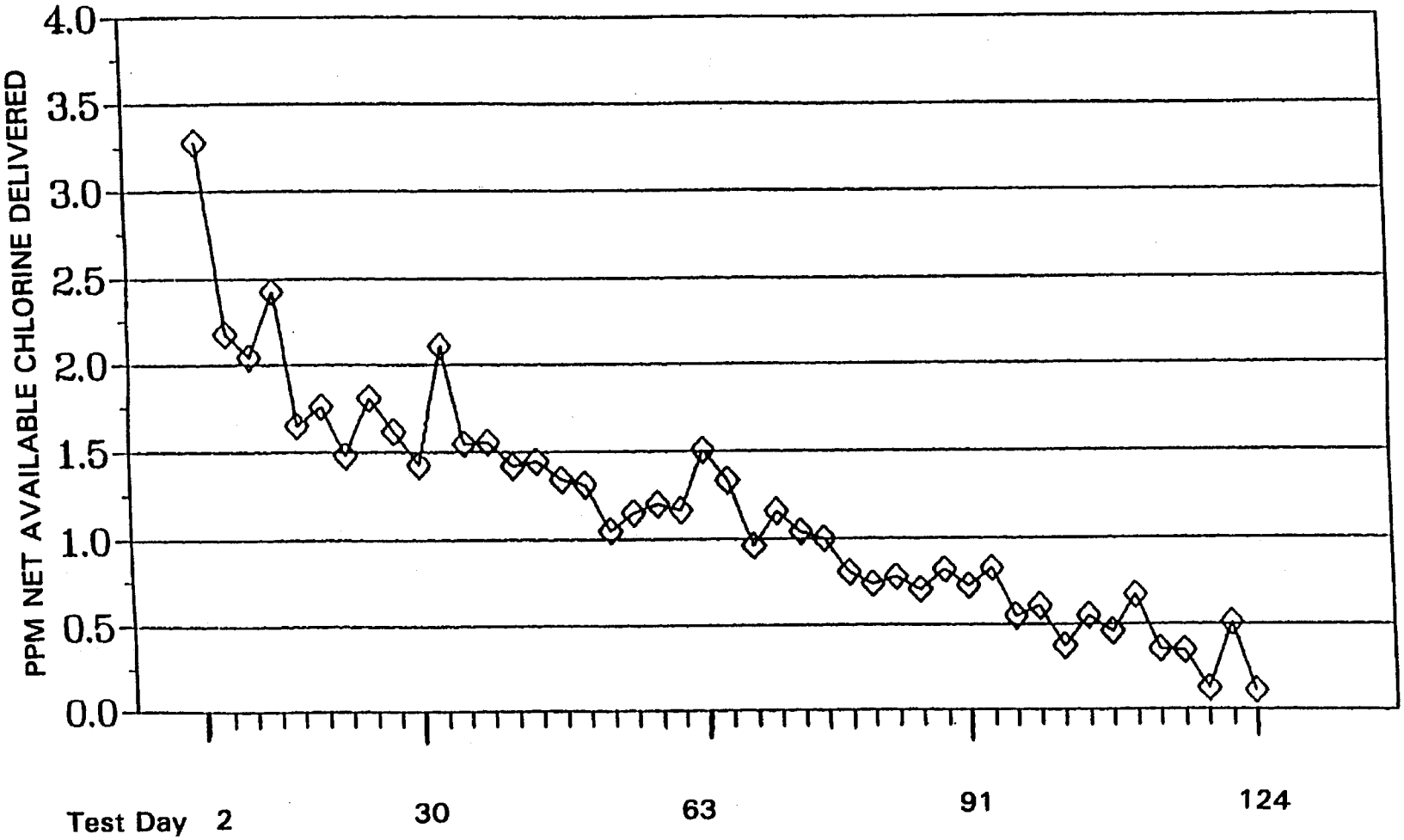
FIG. 1 is a graph showing the ppm net available chlorine delivered by an average of six 100 gram units of a commercial product made in accordance with the Hung et al. patent over a 120 day cycle.

Reference will now be made in detail to the presently preferred embodiments of the invention.

The toilet cleaning block of the invention is a coherent solid comprising an admixture of an agent that releases a halogen containing sanitizing agent when in contact with water, a bulking agent, and a sacrificial dissolution rate regulation agent. The block may also contain minor amounts of other materials such as up to about 1% by weight of an internal mold release lubricant. An external lubricant may also be used in the manufacturing process to help release the block from the mold. Other additive that do not substantially interfere with the operation of the block may also be present, including various cosmetic additives to make the product more acceptable to consumers.

As used herein the term "block" is not intended to limit the shape of product to any one configuration. Circular tablets, cubes, spheres and any other desired shapes are within the definition of the term "block" as used herein.

The agent that releases a halogen containing sanitizing agent when in contact with water comprises the major part of the toilet cleaning block of the invention. Any such agent known heretofore can be used. It is preferred that such agents are N-halogenated organic compounds. Preferred compounds are chlorinated and/or brominated phthalimides, p-toluene sulfonamides, azodicarbonamidines, hydantoins, glycoluracils, cyanurates, amines, melamines and the like. Among these preferred compounds are N-chloro-phthalamide, N-bromo-phthalamide, N-dichloro-p-toluene sulphonamide, 2,5-N,N'-dichloro-azodicarbonamidine hydrochloride, N,N'-dichloro-dimethyl-hydantoin, N-bromo-N'-chlorodimethyl-hydantoin, N,N'-dibromo-dimethyl-hydantoin, N-bromo-N-chloro-diphenyl-hydantoin, N,N,N, N-tetrachlorodimethyl-glycoluracil, N-bromo-N,N-dichloro-dimethylglycoluracil, N,N'-dibromo-dimethyl-glycoluracil, N,N,N,N-tetrachloro-glycoluracil, N,N-dichlorodichloroyl, N-bromo-N-chloro-sodium cyanurate, dibromo triethylene diamine dihydrochloride, bromo-chlorotriethylene diamine dihydrochloride and N,N,N-trichloromelamine.

In the invention, dialkyl substituted hydantoins and especially chlorinated 5,5-di-$C_{14}$ alkyl substituted hydantoins are preferred. 1,3-dichloro-5,5-dimethyl-hydantoin is the most preferred compound.

Preferably, the halogen containing sanitizing agent comprises from about 50% to about 80% by weight of the block, preferably from about 60% to about 70% by weight and most preferably about 65% by weight of the block.

The bulking agent of the invention is preferably aluminum hydroxide. Solid halo-5,5-dialkyl substituted hydantoins dissolve slowly in water. The rate of solubility can be increased substantially by the use of a relatively small amount of a solubilizing agent such as magnesium oxide, barium hydroxide, sodium bicarbonate, sodium carbonate, or other known compounds. Aluminum hydroxide will decrease the rate of solubilization. In U.S. Pat. No. 5,178, 787to Hung et al., it was discovered that if the quantity of the aluminum hydroxide was maintained within a certain range, namely between about 5 and 10% based on the weight of the toilet cleaning block, preferably about 6–8% and especially about 6.5 to 7.5% by weight, and if the block was prepared such that it had a density falling within a particular range, namely 1.1 to 1.6 g/cc and also if the ratio of effective surface area to weight fell within a certain range, namely about 1:1.05 to 1:1.25, the toilet cleaning block would release a controlled, substantially constant rate of halogen containing sanitizing agent within the range of 0.5 to 5 ppm over a period of 2 to about 4 months of constant contact with water. The block will deliver a constant, uniform efficacious level of halogen (0.5–3 ppm) for about 1700 to 2100 flushes and will be completely dissolved at the end of its useful life, leaving no residue in the tank.

In this invention, the bulking agent comprises from about 20% to about 40% by weight of the block, preferably from about 25% to about 35% by weight, and most preferably about 30% by weight of the block.

The toilet cleaning block preferably has a density from about 1.3 to about 1.8 g/cc, more preferably from about 1.30 to about 1.60 g/cc. The ratio of effective surface area (in square centimeters) to weight (in grams) is preferably from about 1:1.05to about 1:1.25 and more preferably from about 1:1.10 to about 1:1.20. "Effective surface area" as used herein is the surface area of the block that is exposed to water in the toilet. In practice, one face or a part of one face of the toilet block will always be resting on an interior surface of the toilet. The effective surface area of the block will therefore be roughly the total surface area of the block less the surface area of one of the largest faces of the block.

The toilet cleaning block comprises a sacrificial dissolution rate regulating agent. This agent may be selected from the group consisting of: sodium chloride, sodium sulfate and potassium chloride. The most preferred agent is sodium chloride. The agent may comprise from about 1% to about 20% by weight of the block, preferably from about 3% to about 10% by weight, and most preferably about 5% by weight of the block. Tests performed using sodium carbonate, sodium bicarbonate, sodium borate, magnesium chloride, lithium chloride, sodium silicate, borax (sodium borate decahydrate) and calcium sulfate were not as successful as those performed with sodium chloride, potassium chloride or sodium sulphate, since the block tended to disintegrate or did not last sufficiently long. Sodium chloride provided the best performance.

Without wishing to be bound by theory, selection of an appropriate agent appears to be affected by the solubility of the agent in water. If the agent is too soluble, the block can be disintegrated by the dissolution process, greatly increasing the effective surface area of the block and deleteriously affecting the longevity of the block in use. If the agent is insufficiently soluble, the agent does not affect the dissolution rate of the block, and no results are observed. If the agent is excessively water swellable, then the water absorption process can also lead to disintegration of the block. If the agent is properly soluble, it dissolves rapidly upon exposure to water, without substantial swelling, and thereby exposes additional surface area of the block to water in the tank.

The toilet cleaning block of the invention is prepared by dry mixing the halogen containing sanitizing agent, the sacrificial dissolution regulating agent and the bulking agent, preferably in finely divided form, and an internal mold lubricant, if needed, in the absence of added water. Any type of mixer such as a twin-shell, ribbon blender or similar type of mixer that is designed to provide a homogenous admixture can be used. The particle size of the sanitizing agent is preferably from about 20 to about 200 mesh, the bulking agent is preferably from about 100 to about 325 mesh and the sacrificial dissolution rate regulation agent is preferably from about 30 to about 70mesh. The admixture is then transferred to the mold of a press whose surfaces can be coated with an external mold lubricant if necessary. Pressure sufficient to provide the desired density and effective surface area/weight ratio is then applied to form a coherent solid resistant to internal water penetration. The solid preferably has a crush fracturing strength from about 20 to about 240 pounds (about 9–109 kg), most preferably from about 40 to about 120 pounds (about 18–543 kg). Such strength is measured by positioning the block perpendicular to the lower base in a Rimac Spring Tester Model #67 (Rinck-McIlwaine Inc., Dumont, N.J.), applying compression and reading the value at fracture from the recoil protected, zero adjust arm on the dial. In order to obtain the desired properties, the pressure will vary depending on the particular chemical employed and the particles sizes of the particulate within the admixture but is generally within the range of about 50 to 890 kg/cm$^2$.

EXAMPLE 1

Six commercial 100 gram tablets (four-month sized products) made in accordance with U.S. Pat. No. 5,178,787 were evaluated for product life and efficacy in the following manner.

The tablets were placed in separate toilet tanks that were flushed 15 times per day. The chlorine content immediately after a flush was measured each day. The end of the test came when the block released less that 0.5 ppm available chlorine for a sufficient time. The average values were plotted as shown in FIG. 1. The results show efficacy over a 120 day cycle.

EXAMPLE 2

Figure 2:
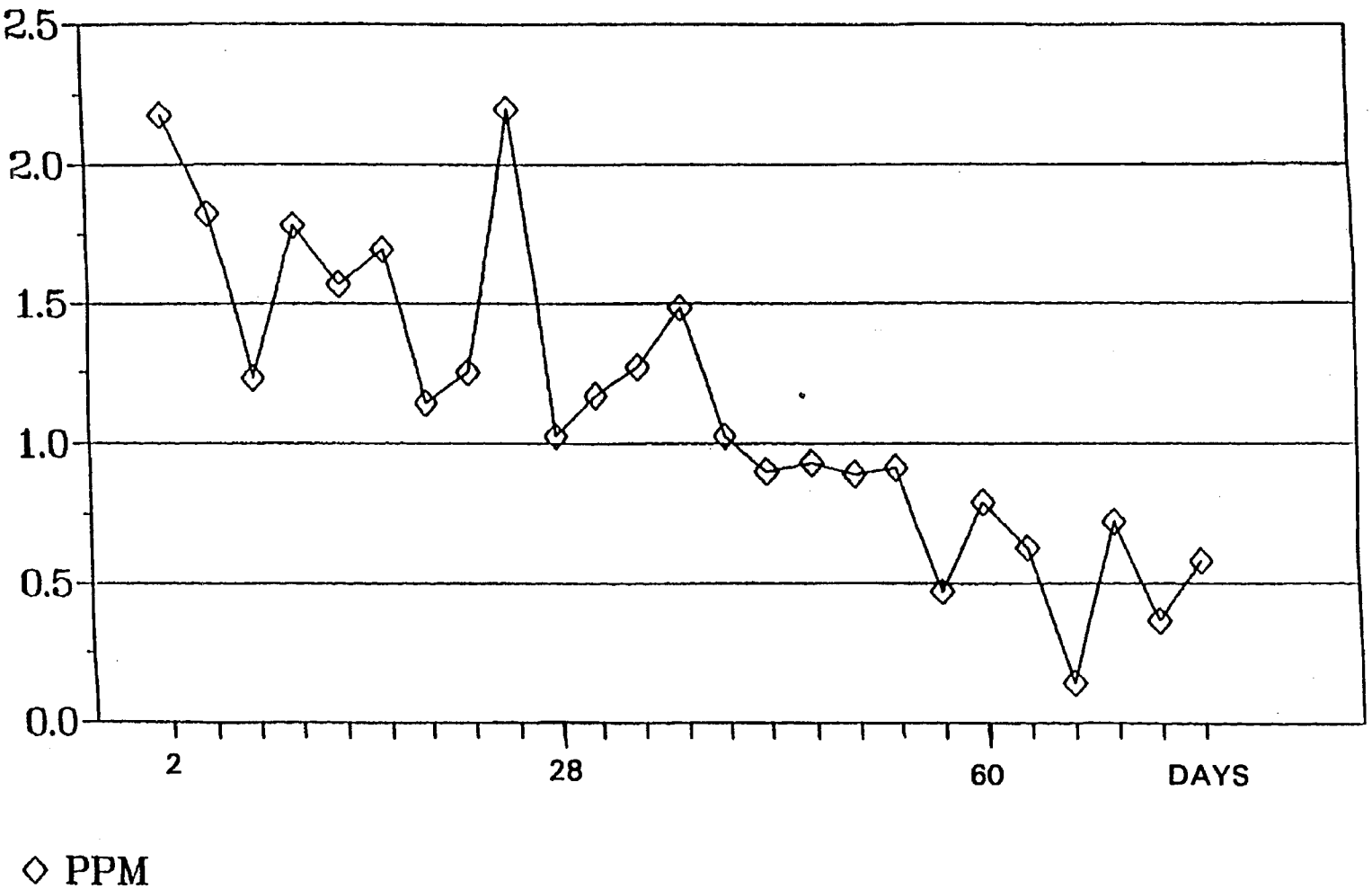
FIG. 2 is a graph of a single 50 gram unit of a commercial product made in accordance with the invention comprising 65% by weight of "Dantochlor" powder (available from Lonza, Inc., Williamsport, Pa., which comprises about 86% 1,3-dichloro-5,5-dimethyl hydantoin, about 3% dichloro-5, 5methylethyl hydantoin and about 11% monocholorinated hydantoins), 30% by weight aluminum hydroxide, and 5% by weight sodium chloride.

A 50 gram (2 month size) tablet comprising 65% by weight Dantochlor powder (about 86% 1,3-dichloro-5,5-dimethylhydantoin), 30% by weight aluminum hydroxide and 5% by weight sodium chloride was tested as in Example 1. The results are shown in FIG. 2. The results show good congruence (when correcting for tablet size) of performance over the desired lifetime of the tablet.

The purpose of the above description is to illustrate some embodiments of the invention without implying a limitation. It will apparent to those skilled in the art that various modifications and variations may be made in the apparatus or procedure of the invention without departing from the scope or spirit of the invention.

What is claimed is:

1. A solid toilet cleaning block comprising a compressed admixture of:

(a) a halogen containing sanitizing agent in an amount sufficient to release an effective amount of sanitizing at a substantially constant rate for at least two months of ordinary use;

(b) a bulking agent; and (c) an effective amount of a sacrificial dissolution rate regulating agent selected from the group consisting of sodium chloride, potassium chloride and sodium sulphate.

2. The block of claim 1, wherein said halogen containing sanitizing agent comprises a N-halogenated organic compound.

3. The block of claim 2, wherein said halogen containing sanitizing agent is selected from the group consisting of: N-chloro-phthalamide, N-bromo-phthalamide, N-dichloro-p-toluene sulphonamide, 2,5-N,N'-dichloro-azodicarbonamidine hydrochloride, N,N'-dichloro-dimethyl-hydantoin, N-bromo-N'-chlorodimethyl-hydantoin, N,N'-dibromo-dimethyl-hydantoin, N-bromo-N-chloro-diphenyl-hydantoin, N,N,N,N-tetrachlorodimethyl-glycoluracil, N-bromo-N,N-dichloro-dimethylglycoluracil, N,N'-dibromo-dimethyl-glycoluracil, N,N,N,N-tetrachloro-glycoluracil, N,N-dichlorodichloroyl, N-bromo-N-chloro-sodium cyanurate, dibromo triethylene diamine dihydrochloride, bromo-chlorotriethylene diamine dihydrochloride and N,N,N-trichloromelamine.

4. The block of claim 1, wherein said halogen containing sanitizing agent is selected from the group consisting of: chlorinated phthalimides, chlorinated and/or brominated, brominated phthalimides, p-toluene sulfonamides, azodicarbonamidines, halogenated hydantoins, glycoluracils, cyanurates, amines, and melamines.

5. The block of claim 1, wherein said halogen containing sanitizing agent comprises from about 50% to about 80% by weight of said block.

6. The block of claim 5, wherein said halogen containing sanitizing agent comprises from about 60% to about 70% by weight of said block.

7. The block of claim 1, wherein said halogen containing sanitizing agent comprises about 65% by weight of said block.

8. The block of claim 1, wherein said bulking agent comprises aluminum hydroxide.

9. The block of claim 1, wherein said bulking agent comprises from about 20% to about 40% by weight of said block.

10. The block of claim 1, wherein said bulking agent comprises from about 25% to about 35% by weight of said block.

11. The block of claim 1, wherein said bulking agent comprises about 30% by weight of said block.

12. The block of claim 1, wherein said sacrificial dissolution rate regulating agent comprises sodium chloride.

13. The block of claim 1, wherein said sacrificial dissolution rate regulating agent comprises from about 1% to about 20% by weight of said block.

14. The block of claim 14, wherein said sacrificial dissolution rate regulating agent comprises from about 3% to about 10% by weight of said block.

15. The block of claim 14, wherein said sacrificial dissolution rate regulating agent comprises about 5% by weight of said block.

16. A solid toilet cleaning block comprising a compressed admixture of:

(a) about 65% by weight of a halogen containing sanitizing agent;

(b) about 30% of bulking agent; and (c) about 5% by weight of a sacrificial dissolution rate regulating agent selected from the group consisting of sodium chloride, potassium chloride and sodium sulfate.

17. The block of claim 17, wherein said halogen containing sanitizing agent comprises a halogenated hydantoin.

18. The block of claim 17, wherein said bulking agent comprises aluminum hydroxide and said sacrificial dissolution rate regulating agent is sodium chloride.

19. The block of claim 17, wherein said bulking agent comprises aluminum hydroxide.

20. The block of claim 17, wherein said sacrificial dissolution rate regulating agent is sodium chloride.

21. A solid toilet cleaning block comprising a coherent solid admixture resistant to internal water penetration having a density of about 1.3–1.8 g/cc, a ratio of the effective surface area to weight of about 1:1.05 to 1:1.25 cc/g and a crush fracturing strength from about 9 to 109 kg, said admixture comprising about 50–80 weight percent of a halogenated hydantoin in an amount sufficient to release an effective amount of sanitizing at a substantially constant rate for at least two months of ordinary use, about 20–40 weight percent of a bulking agent comprising aluminum hydroxide and about 1–20 weight percent of a sacrificial dissolution rate regulating agent selected from the group consisting of sodium chloride, potassium chloride and sodium sulphate.

22. The solid toilet cleaning block of claim 21, wherein the density is about 1.3–1.6 g/cc, the ratio of effective surface area to weight is about 1:1.10 to 1:1.2 cc/g, the halogenated hydantoin comprises about 60–70 weight percent of the block, the bulking agent is about 25–35 weight percent of the block and the sacrificial dissolution rate regulating agent is sodium chloride in an amount from about 3–10 percent by weight of the block.

23. The block of claim 22, wherein the halogenated hydantoin is a chlorinated hydantoin and is present in an amount of about 65% by weight, the bulking agent is about 30% by weight and the sodium chloride is about 5% by weight.

* * * * *